US009337525B2

(12) United States Patent
Dai

(10) Patent No.: US 9,337,525 B2
(45) Date of Patent: May 10, 2016

(54) HIDDEN WINDOW ANTENNA

(71) Applicant: David Dai, Novi, MI (US)

(72) Inventor: David Dai, Novi, MI (US)

(73) Assignee: Pittsburgh Glass Works, LLC, Pittsburgh, PA (US)

( * ) Notice: Subject to any disclaimer, the term of this patent is extended or adjusted under 35 U.S.C. 154(b) by 110 days.

(21) Appl. No.: 14/171,114

(22) Filed: Feb. 3, 2014

(65) Prior Publication Data

US 2015/0222006 A1 Aug. 6, 2015

(51) Int. Cl.
*H01Q 1/32* (2006.01)
*H01Q 1/12* (2006.01)
*H01Q 13/10* (2006.01)

(52) U.S. Cl.
CPC ..... *H01Q 1/1271* (2013.01); *H01Q 13/10* (2013.01)

(58) Field of Classification Search
CPC ..... H01Q 1/1271; H01Q 1/27
USPC ..... 343/712, 713, 767, 769
See application file for complete search history.

(56) References Cited

U.S. PATENT DOCUMENTS 4,707,700 A 11/1987 Nagy
4,768,037 A 8/1988 Inaba et al.
4,849,766 A 7/1989 Inaba et al.
4,864,316 A 9/1989 Kaoru et al.
5,005,020 A * 4/1991 Ogawa ..... B32B 17/10 343/713
5,012,255 A 4/1991 Becker
5,083,135 A 1/1992 Nagy et al.
5,355,144 A * 10/1994 Walton et al. ..... 343/713
5,528,314 A 6/1996 Nagy et al.
5,610,618 A 3/1997 Adrian et al.
5,670,966 A 9/1997 Dishart et al.
5,739,794 A 4/1998 Nagy et al.
5,898,407 A 4/1999 Paulus et al.
5,933,119 A * 8/1999 Fujii ..... H01Q 1/1278 343/704
6,147,654 A 11/2000 Nagy
6,191,746 B1 2/2001 Nagy
6,266,023 B1 7/2001 Nagy et al.
6,317,248 B1 * 11/2001 Agrawal et al. ..... 359/265
6,320,276 B1 11/2001 Sauer
6,396,445 B1 5/2002 Saitoh et al.
6,448,935 B2 9/2002 Fuchs et al.
6,937,198 B2 8/2005 Iijima et al.
7,071,886 B2 7/2006 Doi et al.
7,132,625 B2 * 11/2006 Voeltzel ..... 219/203
7,764,239 B2 7/2010 Baranski
7,847,745 B2 12/2010 Martin
8,189,254 B2 * 5/2012 Voss et al. ..... 359/238
2012/0098715 A1 4/2012 Dai
2012/0098716 A1 4/2012 Dai
2016/0006112 A1 * 1/2016 Kagaya ..... H01Q 1/1285 343/712

* cited by examiner

*Primary Examiner* — Peguy Jean Pierre
(74) *Attorney, Agent, or Firm* — Cohen & Grigsby, P.C.

(57) ABSTRACT

A vehicle slot antenna wherein an electro-conductive coating is applied to the surface of a glass ply. The peripheral edge of the conductive coating is spaced from the vehicle window edge and connected to a high conductive bus bar to define an annular slot antenna with low resistance loss and improved antenna efficiency. The slot antenna is fed by a thin conductive line located in the middle of the slot and parallel to the bus bar. The thin line along with the conductive coating and window frame form a coplanar waveguide (CPW). The CPW feed provides a convenient feed for the antenna at any point around the perimeter of the window slot and affords antenna tuning and impedance matching. The antenna design can use the characteristic impedance of the CPW line to match the impedance of the slot antenna to the impedance of a coaxial cable or other input impedance.

41 Claims, 5 Drawing Sheets

HIDDEN WINDOW ANTENNA

TECHNICAL FIELD

The present invention relates generally to vehicle antennas and, more particularly, to an antenna formed in association with a transparent ply having an electrically conductive coating.

BACKGROUND OF THE INVENTION

Antennas have been proposed which use the theory of operation of quarter or half wavelength antenna in combination with a vehicle window having a thin IR reflective film or conductive coating on or between the layers of the glass window. For example, U.S. Pat. Nos. 4,849,766, 4,768,037, and 4,864,316 illustrate a variety of antenna shapes that are formed by a thin film on a vehicle window. U.S. Pat. No. 5,670,966 discloses an automotive antenna having several electrically interconnected coating regions. U.S. Pat. Nos. 5,083,135 and 5,528,314 illustrate a vehicle antenna having a transparent coating in the shape of a "T". U.S. Pat. No. 6,448,935 discloses an antenna having a two-piece conductive coating that is used as AM and FM antenna that are separated to reduce AM noise and improve system performance.

Other designs include a slot antenna that is formed between the metal frame of a window and a conductive transparent film or coating that is bonded to the window wherein an outer peripheral edge of the transparent film is spaced from the inner edge of the window frame to define a slot antenna. Such antennas are illustrated in U.S. Pat. Nos. 4,707,700 and 5,355,144. U.S. Pat. No. 5,898,407 purports to improve transmission and reception of radio frequency waves by use of a conductive coating with at least one edge that overlaps the window frame of the vehicle body to establish a short to ground by coupling for high frequency signals. U.S. Pat. No. 7,764,239 B2 discloses the use of a laser beam to create a slot antenna by removing the conductive coating. Since the antenna feeding cable has to cross the slot, a large space on the window is required to conceal the antenna feed structure, thus restricting the antenna location to top of the window. U.S. Pat. No. 6,320,276, B1 discloses an antenna feeding structure that uses a capacitive coupling apparatus in which wires are capacitively coupled to the slot antenna.

From an aesthetic point of view, a slot antenna is generally preferred because the antenna is invisible so that it has broader application. Another advantage of slot antennas is heat load reduction because the slot antenna involves removal of an area of the heat reflective coating that is relatively small compared to many other antenna designs. However, slot antennas also present several technical challenges, especially when used in connection with the vehicle windshield window. First, the area around the window perimeter for locating the antenna elements is limited. That limitation makes it difficult to design an antenna that meets typical performance requirements. Secondly, the size and dimensions of the slot antenna lend window slot antennas more to use with the VHF frequency band. At the UHF band, the slot antenna generally has a much weaker resonance and gain because the UHF band is carried in the higher order modes of the slot for which impedance is much higher and impedance matching of the antenna more difficult. For example, the perimeter of the window defines the maximum slot length. Maximum slot length determines the fundamental mode and the lowest frequency for the antenna. Usually that frequency is in the VHF band. Typical windshield and back glass window slot antennas can cover the FM frequency band, but not the TV VHF and UHF bands (47 MHz-860 MHz).

Therefore, it would be advantageous to provide an antenna, particularly a windshield antenna, that is hidden and that also supports a wide frequency band for different applications.

SUMMARY OF THE INVENTION

The presently disclosed invention concerns a slot antenna that is suitable for use in vehicle applications. The disclosed antenna has improved impedance matching and frequency tuning capability. The slot antenna affords improved performance in the VHF and UHF bands while also retaining the solar benefits of the heat reflective coating and excellent aesthetics.

The slot antenna is formed between the metal frame of a ply and an electrically conductive film layer or coating that is bonded to the ply. In the particular embodiment that is further disclosed herein, the presently disclosed invention is a ply of laminate window wherein both the ply and the conductive film layer or coating are transparent. However, it will be apparent to those skilled in the art that the presently disclosed invention can also encompass laminate plys and electrically conductive coatings or film layers in a panel that is not optically transparent to human vision. In the example of the disclosed embodiment, a window includes a transparent ply and a transparent film that is bonded to the window ply. The transparent film has an outer peripheral edge that is spaced from the inner edge of the window frame. The slot dimension is designed to support fundamental modes within frequency bands of interest. Preferably, the total slot length is one wavelength for an annular shaped slot or one half-wavelength for non-annular shaped slot for the fundamental excitation mode.

The slot antenna is excited by a voltage source such as a balanced parallel transmission line that is connected to the opposite edges of the slot or by a coaxial transmission line that is connected to the opposite edges of the slot. Energy applied to the slot antenna causes electrical current flow in the conductive coating and metal frame of the window. The electrical currents are not confined to the edges of the slot, but rather spread out over the conductive sheet. Radiation then occurs from the edges and both sides of the conductive sheet.

The IR reflective coatings have one or more layers of silver and typically have a sheet resistance of about 3Ω/□ for an optical transmission of about 75%. Electrical currents that flow on the coating surface result in resistance losses that impair antenna performance. To increase antenna efficiency, a bus bar such as silver or copper is printed onto the surface of the glazing near the edge of the slot antenna and is electrically connected to the conductive IR coating. The electrical conductivity of the bus bar is high relative to the conductive coating such that the slot antenna is defined by the edge of the conductive coating, the bus bar and the edge of the window frame. Most of the electrical current flows and concentrates on the high conductive bus bar so that resistance loss is relatively low. The increased conductivity in the current flow path also increases antenna radiation efficiency.

The slot antenna is fed by a thin conductive line that is situated in the middle of the slot and oriented parallel with the edge of the bus bar that defines the slot. The antenna feed point is where the feed line is connected to the bus bar. For high-frequency applications, the feed point is preferably near the top of the window. The thin conductive line in combination with the conductive coating and window frame form a coplanar waveguide (CPW). The CPW line not only provides a convenient antenna feed at any point around the perimeter of the window slot, but also affords opportunity for improved antenna tuning and impedance matching. The characteristic impedance of the CPW line can be designed to cause the slot antenna impedance to match the impedance of a coaxial cable or the input impedance of the electronic device which often defined as 50Ω.

The CPW lines also can feed the slot antenna at both sides and at the bottom. Different feed locations will excite different modes of the slot antenna with different field distribution so as to provide antenna diversity in a system or different antenna characteristics for different applications.

BRIEF DESCRIPTION OF THE DRAWINGS

For a more complete understanding of the disclosed invention, reference should now be had to the embodiments illustrated in greater detail in the accompanying drawings and described below by way of examples of the invention. In the drawings.

DETAILED DESCRIPTION OF THE INVENTION

Figure 1:
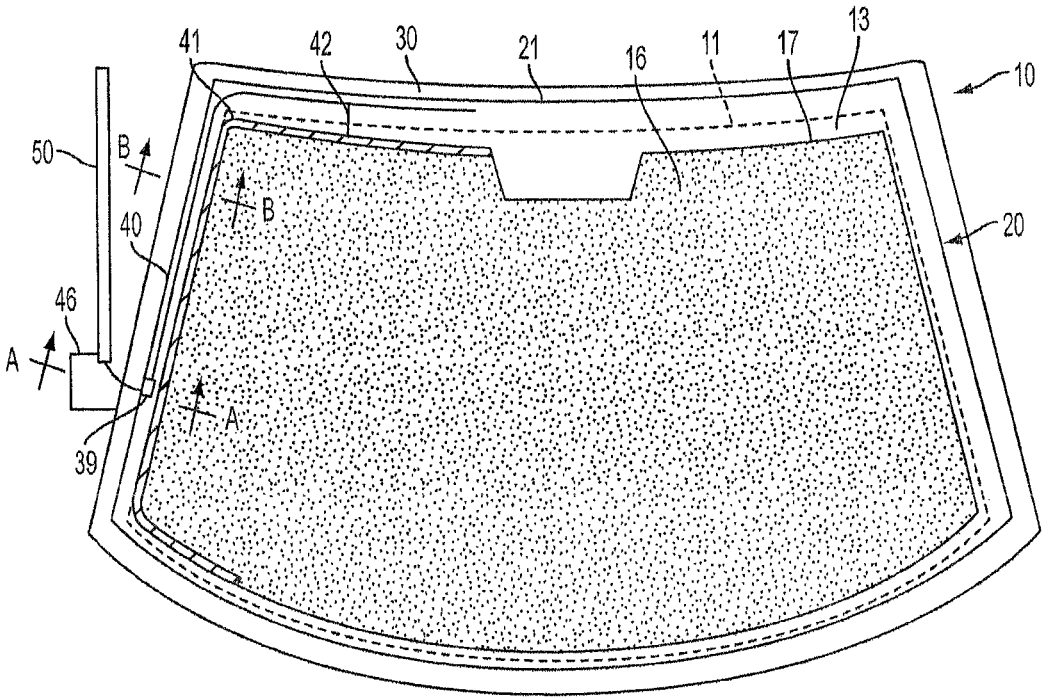
FIG. 1 is a plan view of a transparent glass antenna incorporating features of the presently disclosed invention.
Figure 2:
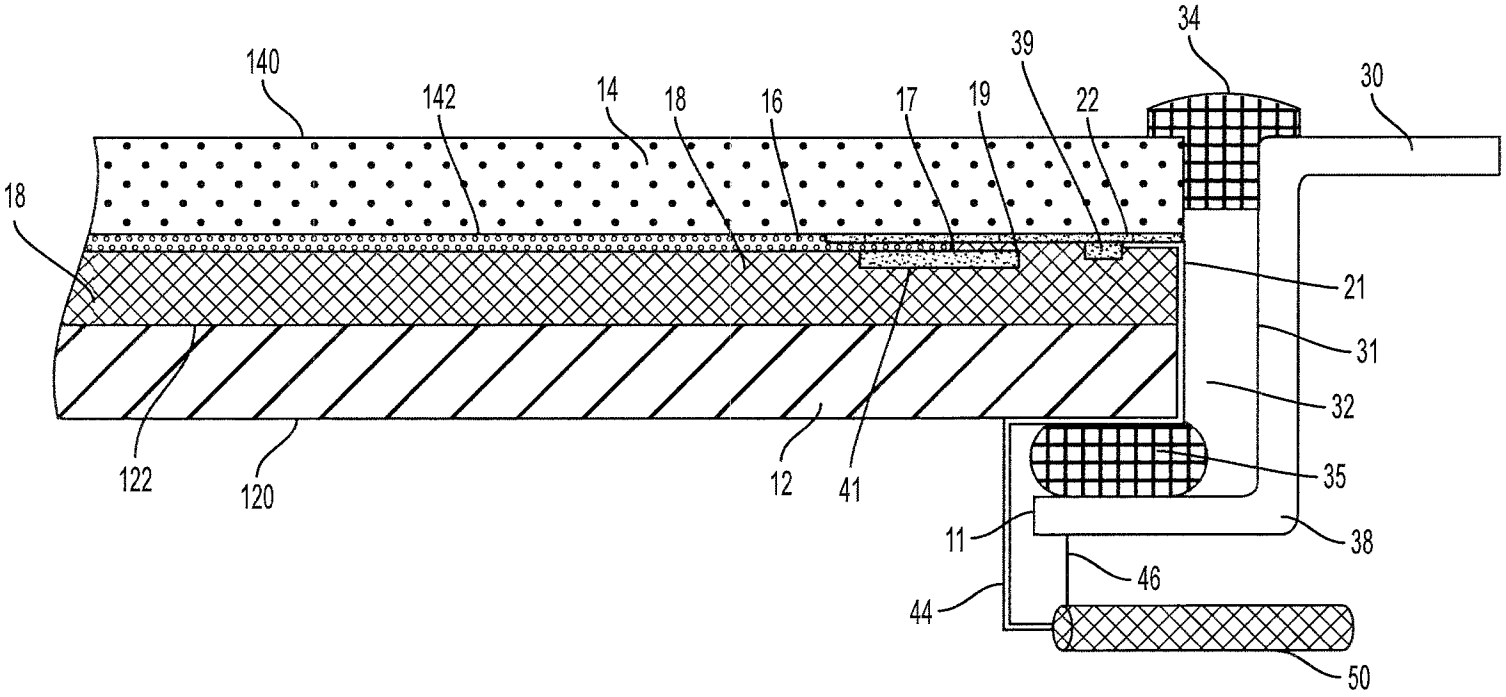
FIG. 2 is sectional view taken along line A-A in FIG. 1.

FIG. 1 is a plan view of transparent antenna windshield 10 and associated structure incorporating features of the presently disclosed invention. The windshield 20 is surrounded by a metal frame, which has a window aperture that is defined by window edge 11 of body 30. The outer edge 21 of windshield 20 overlaps the annular flange 38 of body 30 to provide, in this embodiment, a windshield for vehicle body 30. As shown in FIG. 2, an annular sealing member 35 is located between window glass 20 and flange 38; and a molding 34 bridges the outer gap between the body 30 and windshield 20. The window opening is defined by the edge 11 and surface 31 of vehicle body 30.

Windshield 20 is a laminated vehicle windshield formed of outer and inner glass plies 14 and 12 bonded together by an interposed layer 18, preferably of a standard polyvinylbutyral or similar plastic material. Outer glass ply 14 has an outer surface 140 (conventionally referred to as the number 1 surface) on the outside of the vehicle and an inner surface 142 (conventionally referred to as the number 2 surface). Inner glass ply 12 has an outer surface 122 (conventionally referred to as the number 3 surface) on the inside of the window glass 20 and an inner surface 120 (conventionally referred to as the number 4 surface) internal to the vehicle. The interlayer 18 is between surfaces 142 and 122.

As shown in FIG. 2, the window glass 20 may include an obscuration band 22 by screen printing opaque ink onto the glazing and subsequent firing around the perimeter of the window glass. The obscuration band 22 is sufficiently wide to conceal the antenna elements and other apparatus around the glass edges that are hereinafter shown and described.

Windshield 20 further includes an electro-conductive coating or element 16 that occupies the daylight opening of the transparency. The conductive coating 16 is incorporated into automotive window glass for use as solar shield to reduce the transmission of infrared and ultraviolet radiation through the window. The element 16 is preferably transparent electro-conductive coatings that are applied on surface 142 of the outer glass ply 14 (as shown in FIG. 2) or on surface 122 of the inner glass ply 12, in any manner well known in the art. The coating may be single or multiple layers of metal-containing coating as, for example, disclosed in U.S. Pat. No. 3,655,545 to Gillery et al.; U.S. Pat. No. 3,962,488 to Gillery and U.S. Pat. No. 4,898,789 to Finley. The conductive element 16 has a sheet resistance of about 3Ω/□ for an optical transmission of about 75%.

Near the edge 21 of the window 20 and partially within the black paint band 22, the conductive coating is removed either by mask deletion or laser deletion to deletion line 17 to prevent corrosion and undesired radio frequency coupling to the window frame. The coating deletion is required for the antenna to be functional. A high conductive bus bar 41 is screen printed onto surface 142 of coated glass ply 14 around the deletion edge 17 of conductive coating 16. Bus bar 41 partially overlays side edge 17 of coating 16 such that bus bar 41 is electrically connected to coating 16 as a solid metal sheet. The bus bar 41 is located partially on the surface of the transparent ply 14. Bus bar 41 has a greater electrical conductivity than the electrical conductivity of the transparent electrically conductive coating 16. Bus bar 41 has a first edge 19 that is spaced between the outer peripheral edge 17 of the electrically conductive coating 16 and the inner edge 11 of the electrically conducting member 30 of the vehicle. The bus bar 41 also has a second edge that is spaced apart from the outer peripheral edge 17 of the electrically conductive coating 16 and over said electrically conductive coating 16 such that the bus bar 41 at least partially overlaps the outer peripheral edge 17 of the electrically conductive coating 16. The bus bar 41 cooperates with the electrically conducting member 30 and with the electrically conductive coating 16 to define a slot antenna between the first edge 19 of the bus bar 41 and the peripheral edge 11 and surface 31 of the electrically conducting member 30.

Windshield 20 and its associated body structures define an annular antenna slot 13 between the window frame edge 11 and surface 31 on one side and the bus bar edge 19 in combination with coating edge 17 on the opposite side. The slot width must be sufficiently large that the capacitive effects across it at the frequency of operation are negligible so that the signal is not shorted out. The slot width is preferably greater than 10 mm. The preferred length of the slot is an integer multiple of wavelength for an annular shaped slot or an integer multiple of one half of the wavelength for a non-annular shaped slot with respect to resonant frequency of application. For a windshield of a typical vehicle, the slot length is such as to resonate at the VHF band and also can be used for the TV VHF band and FM applications.

The slot antenna is fed by a thin conductive line 40 that is situated half-way between edge 21 of glass 14 and the edge 19 of bus bar 41 and is in parallel with edge 19 of bus bar 41. The feed line 40 is connected to bus bar 41 near the top of the window by a vertical line 42 that defines the antenna feed point. Line 40 along with the conductive coating 16, bus bar 41, and window frame 30 forms a coplanar waveguide (CPW).

As illustrated in FIG. 2, a copper foil 32 is conductively connected to a solder patch 39 that is connected to one end of line 40 and that is laminated with interlayer 18 between outer and inner glass plies 14 and 12. The copper foil exits from the edge 21 of the windshield, folds back around the edges of interlayer 18 and inner glass ply 12, and is sandwiched between surface 120 of inner glass ply 12 and glue bead 35. The copper foil 32 is conductively connected to the center conductor 44 of coaxial cable 50 or a vehicle electronic device (not shown). Preferably the copper foil 32 is covered by a plastic tape so that it is isolated from contact with the window body 30 and shorts out the radio frequency signals where it passes through window flange 38 and glue bead 35. The antenna is grounded to the vehicle body through a cable ground wire 46. The cable ground wire 46 is connected to the window frame near the inner metal edge 11 of the window flange 38.

When the slot antenna is excited by the CPW feed line 40, electrical current flows in the conductive coating 16 and metal frame 30 of the window. The currents concentrate at the edges of the slot and spread out over the conductive sheet. Radiation occurs from the edges and both sides of conductive sheet 16.

The edges and surfaces of coating 16 have relatively low conductivity such that current flow on the coating edges and surfaces results in resistive losses that compromise antenna performance. For a slot antenna, the electrical current concentrates near the antenna feed point and the edges of the slot resulting in significant resistance losses on the surfaces and edges of conductive coating 16. In order to increase antenna efficiency, a high conductive bus bar 41 such as silver or copper is printed on the high current density area along the edge of the slot antenna and in contact with the IR coating. The high conductive bus bar 41 causes the slot antenna to be defined by the edge 19 of bus bar 41 and the edge 11 and surface 31 of the window frame 30. Most of the current flows and concentrates on the high-conductive material of bus bar 41 resulting in low loss. The increased conductivity of the current path increases antenna radiation efficiency. The wider bus bar 41 also provides uniform current distribution and avoids high current density to further reduce signal resistance loss. Preferably, the bus bar 41 covers the entire length of the edge of the slot for best performance. However, the most significant portion of the current path is about one-half wavelength to one wavelength from the antenna feed point where the current density is the highest. In the embodiment of FIG. 1, the bus bar covers only a portion of the coating edge 17. An advantage in using the shorter bus bar is cost. Traditionally, bus bar 41 and CPW line 40 are screen printed silver paste on the glazing and subsequently fired to dry and cure the bus bars. The shorter bus bar requires less silver and therefore has a lower cost.

Figure 3:
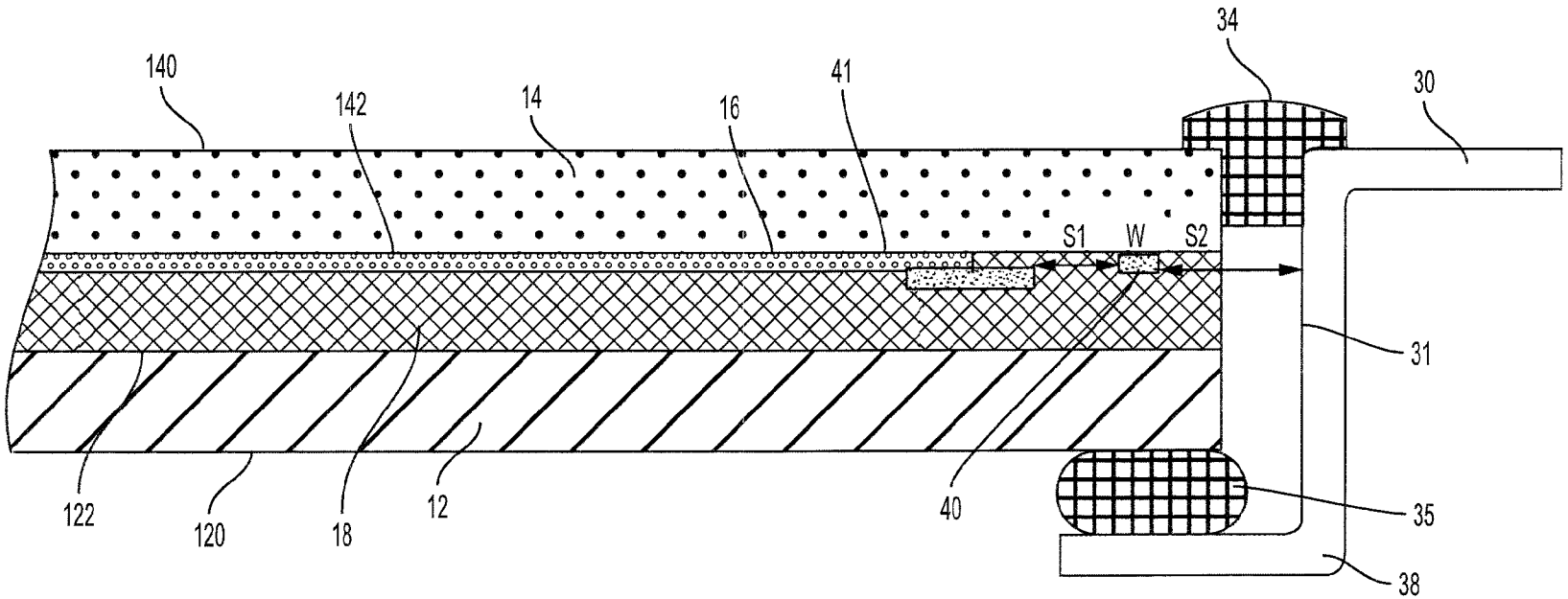
FIG. 3 is sectional view taken along line B-B in FIG. 1.

The CPW antenna feeding network not only provides a convenient means to feed the antenna at any point along the antenna slot, but also affords an opportunity for antenna tuning and impedance matching to maximize radio frequency energy transfer. Normally, slot antenna impedance is much higher than 50Ω. The antenna feeding structure 40, 41, 42 presents an impedance transfer into the slot antenna modes with its own impedance, which is a function of feed position, frequency and mode. The characteristic impedance of the CPW line can be designed to transform the slot antenna impedance to match the impedance of a coaxial cable or the input impedance of the electronic device which are often defined as 50Ω. Referring to FIG. 3, the characteristic impedance of the CPW is a function of relative permittivity $\epsilon_r$ of glass plies 12, 14 and interlayer 18, width W of trace 40, spacing S1 between trace 40 and the edge 19 of bus bar 41, spacing S2 between trace 40 and window frame 30, and substrate thickness of glass plies 12, 14 and interlayer 18. Of those parameters, S1, S2 and W are adjustable variables that can be used to optimize the CPW design so as to match the impedance of the antenna to the impedance of the coaxial cable 50 or other input device. The CPW antenna feed network also simplifies the antenna module package. Essentially, the antenna feed point can be located anywhere along the feed line 40 so that antenna modules can be located anywhere around the perimeter of the windshield.

Figure 4:
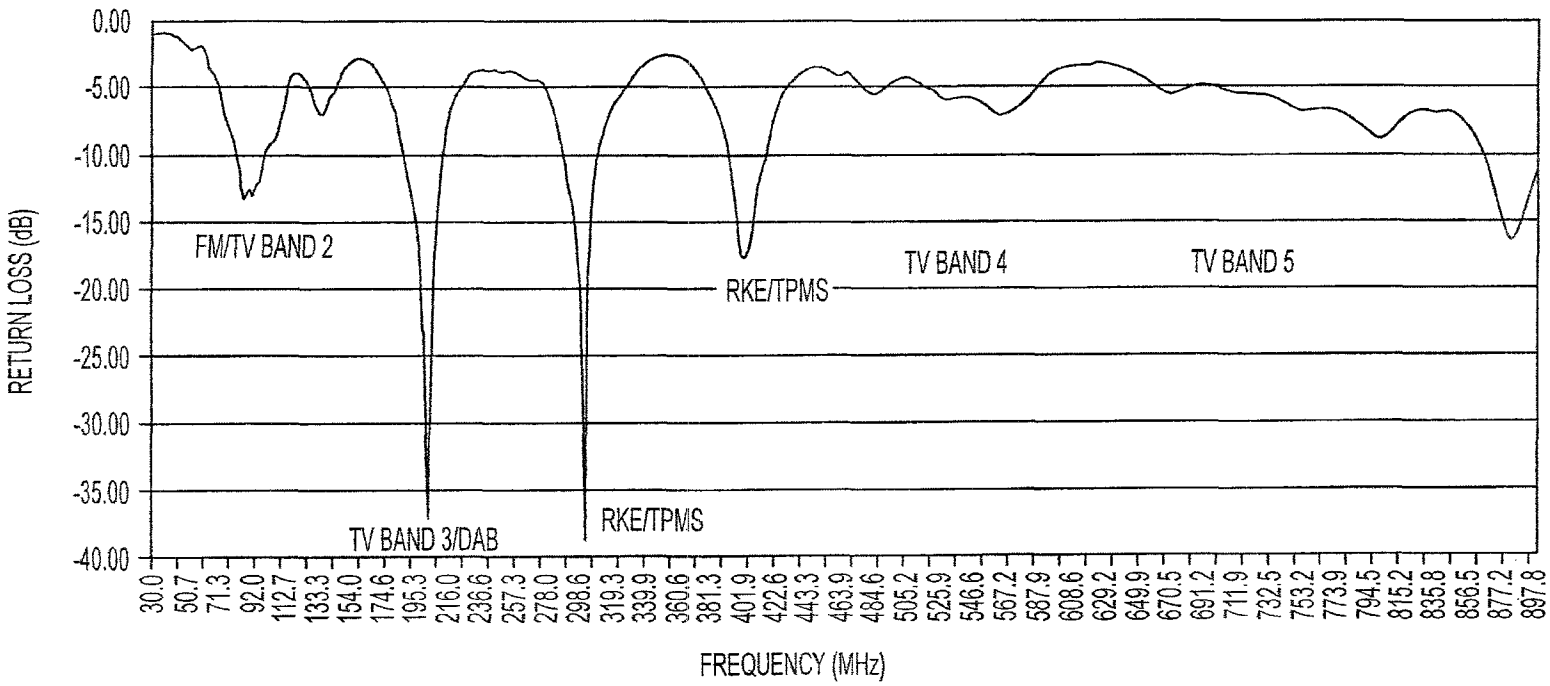
FIG. 4 is plot of the antenna return loss illustrating the antenna resonant frequency bands from 30 MHz to 900 MHz.

An embodiment similar to that illustrated in FIG. 1 was constructed and tested on a vehicle. FIG. 4 is the plot of the return loss (S11) of the slot antenna. Of the power delivered to the antenna, return loss S11 is a measure of how much power is reflected from the antenna and how much is "accepted" by the antenna and radiated. FIG. 4 shows that the antenna resonates well in multiple frequency bands from 70 MHz up to 900 MHZ which covers FM/TV band II (76-108 MHz), TV band III (174 MHz-230 MHz), digital audio broadcasting (DAB III) (174 MHz-240 MHz), Remote Keyless Entry (RKE) and tire pressure monitor system (TPMS) (315 MHz and 433.92 MHz), TV band IV and V (474 MHz-860 MHz). Results of far-field gain measurements show that the antenna performs very well at all TV bands with equal or better antenna gain compared to traditional embedded wire or silver print window antennas. The slot antenna demonstrates capability for multi-band application which can reduce the number of antennas, simplify antenna amplifier design, and reduce overall costs for the antenna system.

When the antenna slot is excited by an electromagnetic wave, the field distribution in the slot can be represented by a set of orthogonal resonate modes. Depending on the antenna feed location and feed method, a combination of multiple modes resonating at different frequencies can be excited. Referring to FIG. 4, the fundamental mode with the lowest resonant frequency can be used for FM and TV band II applications, while the second order mode is in the TV band III and DAB III band. The higher order modes resonating at UHF frequency bands can be used for RKE, TPMS, and TV band 4 and band 5 applications. It has been found that the antenna performs the best for the UHF band when it is fed near the top of the slot antenna. For the VHF band, top feed slot antenna performance is nearly the same as the bottom feed. Since the electrical current distribution of each antenna resonate mode is different when the antenna is excited at different locations, the antenna radiation pattern is also different which affords antenna diversity. For higher frequencies the slot is effectively longer and hence more than one mode can be excited. This leads to a greater variation in excitation and hence pattern diversity e.g. at UHF the slot can be excited at various points $\lambda/4$ apart to generate different antenna gain patterns.

Figure 5:
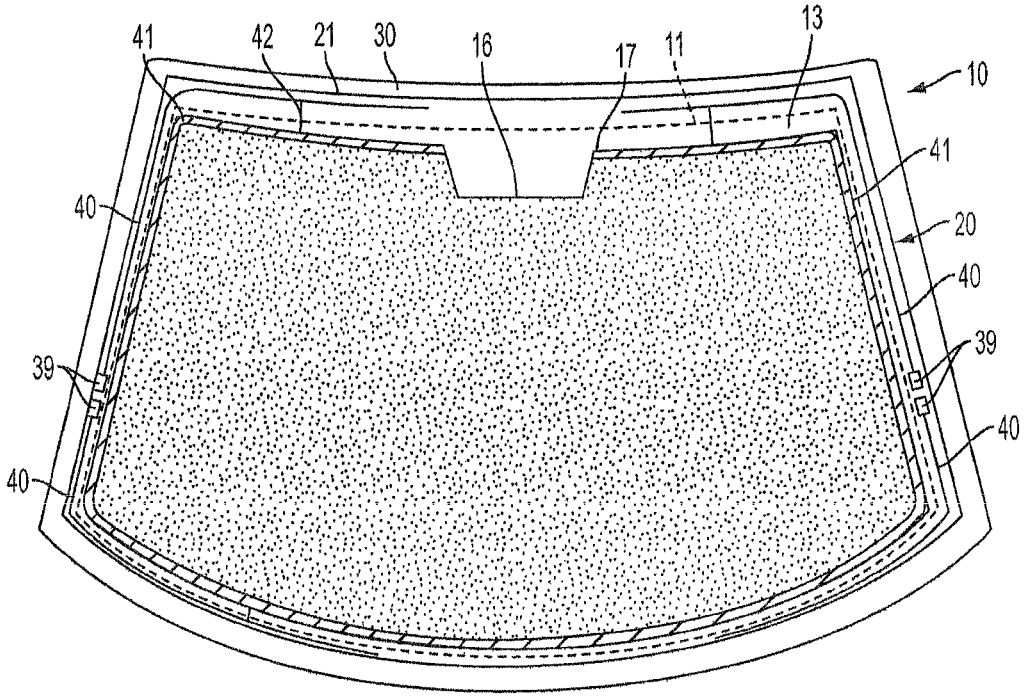
FIG. 5 is a plan view of a transparent glass antenna system with four separate antennas for diversity reception.

The embodiment of FIG. 5 represents a further development in accordance with the presently disclosed invention. FIG. 5 illustrates four separate slot antennas that are incorporated in the windshield. Each antenna is fed independently by a CPW line at the A-pillars. The top two antennas are symmetrically located along two sides of the windshield. Since the two antenna feeds are at least $\lambda/4$ wavelength apart, they are weakly coupled, i.e. both can be used simultaneously for FM and TV diversity antenna system. The same is true for the bottom two antennas which can be used for FM diversity. The antenna can be fed also at both sides of the window transparency resulting in still further spatial and pattern diversity. The antenna feed at the sides of the window provides more antenna gain for horizontal polarization while antenna feed at top and bottom gives more gain in vertical polarization. Intentionally, bus bar 41 is not connected in the third visor area to reduce current flow near the area. This reduces unwanted electromagnetic coupling between the antenna and vehicle electronics that are mounted near the rear view mirror such as IR camera, night view camera, and rain sensor.

While the invention has been described and illustrated by reference to certain preferred embodiments and implementations, it should be understood that various modifications may be adopted without departing from the spirit of the invention or the scope of the following claims.

What is claimed is:

1. An antenna that is included in a panel assembly, said antenna comprising:

a frame member for receiving the panel assembly, said frame member being electrically conductive and having an edge and a surface that defines an opening through the frame member;

at least one ply having a surface that is defined by an outer perimeter edge;

an electrically conductive coating that is located on the surface of said ply, said electrically conductive coating having an outer peripheral edge that is spaced inwardly from the outer perimeter edge of said ply;

a bus bar that has greater electrical conductivity than the electrical conductivity of said electrically conductive coating, said bus bar being located partly on said electrically conductive coating and partly on the surface of said ply, said bus bar having a first edge that is spaced laterally between the outer peripheral edge of said electrically conductive coating and said frame member, said bus bar cooperating with said frame member and with said electrically conductive coating to define a slot antenna;

an antenna feed line that is laterally located on the surface of said ply between the first edge of said bus bar and said frame member, said antenna feed line being substantially parallel to the first edge of said bus bar; and an antenna feed point that electrically connects said antenna feed line to said bus bar.

2. The antenna of claim 1 wherein said bus bar also has a second edge that is spaced laterally inwardly from the outer peripheral edge of said electrically conductive coating such that said bus bar overlaps at least a partial length of the outer peripheral edge of said electrically conductive coating.

3. The antenna of claim 2 wherein said bus bar cooperates with the peripheral edge of said electrically conductive coating to define one side of said slot antenna and wherein the edge and surface of said frame member defines the opposite side of said slot antenna.

4. The antenna of claim 3 wherein the impedance of the antenna is established in accordance with at least one of the lateral dimension between the antenna feed line and the first edge of said buss bar, the lateral dimension between the antenna feed line and the frame member, and the width of the antenna feed line.

5. The antenna of claim 3 wherein said bus bar is connectable to said antenna feed line through said antenna feed point at any location along said antenna feed line.

6. The antenna of claim 3 wherein the lateral location of said antenna feed line between the first edge of said bus bar and the perimeter edge of said ply defines an antenna design.

7. The antenna of claim 6 wherein the panel assembly includes a plurality of antenna designs, the antenna feed line for each respective antenna having a lateral location between the first edge of said bus bar and the perimeter edge of said ply that defines the respective antenna design.

8. The antenna of claim 7 wherein the antenna feed point of at least one antenna design is located within the slot between the first edge of the bus bar and a length of the frame member located at the top of the opening through the frame.

9. The antenna of claim 7 wherein the antenna feed point of at least one antenna design is located within the slot between the first edge of the bus bar and a length of the frame member located at the bottom of the opening through the frame.

10. The antenna of claim 7 wherein the antenna feed point of at least one antenna design is located within the slot between the first edge of the bus bar and a length of the frame member located at a side of the opening through the frame.

11. An antenna for use in a vehicle that includes an electrically conducting member having an inner edge and surface that defines a window opening, said antenna comprising:

(a) an optically transparent window assembly that is operable to be secured over the window opening, said window assembly including:

at least one transparent ply having a surface that is defined by an outer edge;

an optically transparent electrically conductive coating that is located on the surface of said transparent ply, said electrically conductive coating having an outer peripheral edge that is spaced laterally inwardly from the inner edge and surface of the electrically conducting member of said vehicle;

a bus bar that is located partially on the surface of said transparent ply, said bus bar having greater electrical conductivity than the electrical conductivity of said transparent electrically conductive coating, said bus bar having a first edge that is spaced laterally between the outer peripheral edge of said electrically conductive coating and the inner edge and surface of the electrically conducting member of said vehicle, said bus bar also having a second edge that is laterally spaced inwardly from the outer peripheral edge of said electrically conductive coating and over said electrically conductive coating such that said bus bar overlaps at least a portion of the outer peripheral edge of said electrically conductive coating, said bus bar cooperating with said electrically conducting member and with said electrically conductive coating to define a slot antenna between the first edge of said bus bar and the inner edge and surface of said electrically conducting member;

an antenna feed line that is located on the surface of said transparent ply laterally between the first edge of said bus bar and the inner edge of said electrically conducting member; and an antenna feed point that electrically connects said antenna feed line to said bus bar;

(b) an antenna feed cable that is electrically connected to said antenna feed line; and (c) an electrical ground between said antenna feed cable and the electrically conducting member of said vehicle.

12. The antenna of claim 11 further comprising a band of opaque coating around the perimeter of the window assembly, said antenna feed being located laterally within the width of said band of opaque coating.

13. The antenna of claim 11 configured for operation in the UHF band wherein said antenna feed is located at the top of the slot.

14. The antenna of claim 11 configured for operation in the VHF band wherein said antenna feed is located at the top of the slot or at the bottom of the slot.

15. The antenna of claim 11 wherein said slot antenna has a single feed and is operative in a frequency band from 70 MHz to 860 MHz.

16. The antenna of claim 11 wherein said slot antenna is fed from multiple coplanar waveguide feed lines that are respectively located at different positions to provide a antenna diversity system that excites different modes of the slot antenna to provide different respective field distributions.

17. The antenna of claim 11 wherein said slot antenna has a slot width that is sufficient to negate capacitive effects across the slot antenna at the operation frequencies.

18. The antenna of claim 11 wherein the antenna feed point of said window assembly comprises an electrically conductive line that is connected to the antenna feed line and to the bus bar.

19. The antenna of claim 11 wherein said slot antenna has an annular configuration and the slot length of said slot antenna is one wavelength at the fundamental excitation mode.

20. The antenna of claim 11 wherein said slot antenna has a configuration that is other than an annular configuration and the slot length of said slot antenna is one-half wavelength at the fundamental excitation mode.

21. The antenna of claim 11 wherein said bus bar is electrically connected to said electrically conductive coating.

22. The antenna of claim 21 wherein the electrical current of said slot antenna is concentrated on the first edge of said bus bar.

23. The antenna of claim 21 wherein said bus bar reduces resistive losses of electrical current to improve antenna efficiency.

24. The antenna of claim 11 wherein said antenna feed line, bus bar, electrically conductive coating, and electrically conducting member of said vehicle form a coplanar waveguide feed.

25. The antenna of claim 24 wherein the dimensions of said coplanar waveguide feed are selected to match the slot antenna impedance to the impedance of an input device.

26. The antenna of claim 24 wherein one or more of the relative permittivity of said transparent ply, the width of said antenna feed line, the spacing between said antenna feed line and the bus bar, the spacing between said antenna feed line and the inner edge of the electrically conducting member of said vehicle, and the thickness of said transparent ply are selected to determine the characteristic impedance of said coplanar waveguide.

27. The antenna of claim 24 wherein said coplanar waveguide slot antenna feed excites both the fundamental mode and higher-order modes in the VHF and UHF bands for multiband applications.

28. The antenna of claim 24 wherein said coplanar waveguide antenna is configured for location at any selected position on the perimeter of said window assembly.

29. An antenna for use in a vehicle that includes an electrically conducting member having an inner edge and surface that defines a window opening, said antenna comprising:

an optically transparent window assembly that is adapted to be secured over the window opening, said window assembly comprising:

an inner ply having an inner surface and an outer surface that are located between an outer edge, an outer ply having an inner surface and an outer surface that are located between an outer edge, an interlayer that is located between the outer surface of said inner glass ply and the inner surface of said outer glass ply;

a transparent electrically conductive coating on inner surface of said outer ply, said electrically conductive coating having an outer peripheral edge that is laterally spaced inwardly from the inner edge and surface of the electrically conducting member of said vehicle;

a bus bar on the inner surface of said outer ply, said bus bar having high electrical conductivity relative to the electrical conductivity of said transparent electrically conductive coating, said bus bar having a first edge that is laterally spaced between outer peripheral edge of said electrically conductive coating and the electrically conducting member of said vehicle, said bus bar also having a second edge that is laterally spaced inwardly from the outer peripheral edge of said electrically conductive coating and over said electrically conductive coating such that said bus bar overlaps the outer peripheral edge of said electrically conductive coating over at least a portion of the length of said peripheral edge, said bus bar cooperating with said electrically conducting member and with said electrically conductive coating to define a slot antenna between the first edge of said bus bar and the inner edge and surface of said electrically conducting member;

an antenna feed line that is located on the inner surface of said outer ply and that is laterally located between the first edge of said bus bar and inner edge of said electrically conducting member, said antenna feed line being electrically connected to said bus bar;

an antenna feed cable that is electrically connected to said antenna feed line; and an electrical ground between said antenna feed cable and the vehicle conducting member.

30. The antenna of claim 29 further comprising a band of opaque coating that is laterally located at the perimeter of the window assembly, said antenna feed being located laterally within the width of said opaque band.

31. The antenna of claim 29 wherein the slot width of said slot antenna is greater than 10 millimeters.

32. An antenna that is included in a panel assembly, said antenna comprising:

a frame member for receiving the panel assembly, said frame member being electrically conductive and having an edge and a surface that defines an opening through the frame member;

at least one ply having a surface that is defined by an outer perimeter edge;

an electrically conductive coating that is located on the surface of said ply, said electrically conductive coating having an outer peripheral edge that is spaced inwardly from the outer perimeter edge of said ply;

a bus bar that has greater electrical conductivity than the electrical conductivity of said electrically conductive coating, said bus bar being located partly on said electrically conductive coating and partly on the surface of said ply, said bus bar having a first edge that is spaced laterally between the outer peripheral edge of said electrically conductive coating and said frame member, said bus bar also having a second edge that is spaced laterally inwardly from the outer peripheral edge of said electrically conductive coating such that said bus bar overlaps at least a partial length of the outer peripheral edge of said electrically conductive coating, said bus bar cooperating with said frame member and with said electrically conductive coating to define a slot antenna;

an antenna feed line that is laterally located on the surface of said ply between the first edge of said bus bar and the perimeter edge of said ply; and an antenna feed point that electrically connects said antenna feed line to said bus bar.

33. The antenna of claim 32 wherein said bus bar cooperates with the peripheral edge of said electrically conductive coating to define one side of said slot antenna and wherein the edge and surface of said frame member defines the opposite side of said slot antenna.

34. The antenna of claim 33 wherein said antenna feed line is laterally spaced between the first edge of said bus bar and said frame member.

35. The antenna of claim 34 wherein the impedance of the antenna is established in accordance with at least one of the lateral dimension between the antenna feed line and the first edge of said bus bar, the lateral dimension between the antenna feed line and the frame member, and the width of the antenna feed line.

36. The antenna of claim 33 wherein said bus bar is connectable to said antenna feed line through said antenna feed point at any location along said antenna feed line.

37. The antenna of claim 33 wherein the lateral location of said antenna feed line between the first edge of said bus bar and the perimeter edge of said ply defines an antenna design.

38. The antenna of claim 37 wherein the panel assembly includes a plurality of antenna designs, the antenna feed line for each respective antenna having a lateral location between the first edge of said bus bar and the perimeter edge of said ply that defines the respective antenna design.

39. The antenna of claim 38 wherein the antenna feed point of at least one antenna design is located within the slot between the first edge of the bus bar and a length of the frame member located at the top of the opening through the frame.

40. The antenna of claim 38 wherein the antenna feed point of at least one antenna design is located within the slot between the first edge of the bus bar and a length of the frame member located at the bottom of the opening through the frame.

41. The antenna of claim 37 wherein the antenna feed point of at least one antenna design is located within the slot between the first edge of the bus bar and a length of the frame member located at a side of the opening through the frame.

* * * * *